US007583186B2

(12) United States Patent
Kuhls et al.

(10) Patent No.: US 7,583,186 B2
(45) Date of Patent: Sep. 1, 2009

(54) UTILIZATION-DEPENDENT DATA REPRESENTATION IN A MOTOR VEHICLE

(75) Inventors: Burkhard Kuhls, Stadtbergen (DE); Horst Kiessling, Freising (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 223 days.

(21) Appl. No.: 11/588,233

(22) Filed: Oct. 27, 2006

(65) Prior Publication Data

US 2007/0073451 A1 Mar. 29, 2007

Related U.S. Application Data

(63) Continuation of application No. PCT/EP2004/004667, filed on Apr. 29, 2004.

(51) Int. Cl.
*G08B 23/00* (2006.01)

(52) U.S. Cl. ..... 340/500; 340/905; 340/901; 340/439; 701/1; 701/200

(58) Field of Classification Search ..... 340/905, 340/901, 902, 438, 439, 441, 500; 701/200, 701/202, 1
See application file for complete search history.

(56) References Cited

U.S. PATENT DOCUMENTS

| | | | | |
|---|---|---|---|---|
| 5,664,948 | A | 9/1997 | Dimitriadis et al. | |
| 5,941,933 | A * | 8/1999 | Miyake et al. | 701/208 |
| 6,097,313 | A * | 8/2000 | Takahashi et al. | 340/905 |
| 6,438,471 | B1 * | 8/2002 | Katagishi et al. | 701/33 |
| 6,484,093 | B1 * | 11/2002 | Ito et al. | 701/211 |
| 6,748,305 | B1 * | 6/2004 | Klausner et al. | 701/35 |
| 6,768,942 | B1 * | 7/2004 | Chojnacki | 701/200 |
| 6,807,464 | B2 * | 10/2004 | Yu et al. | 340/902 |
| 6,873,905 | B2 * | 3/2005 | Endo et al. | 701/202 |
| 6,952,643 | B2 * | 10/2005 | Matsuoka et al. | 340/995.13 |
| 7,337,456 | B1 * | 2/2008 | Nihei | 725/35 |
| 7,339,483 | B1 * | 3/2008 | Farmer | 340/576 |
| 2002/0044049 | A1 * | 4/2002 | Saito et al. | 340/438 |
| 2002/0087263 | A1 | 7/2002 | Wiener | |

(Continued)

FOREIGN PATENT DOCUMENTS

| | | |
|---|---|---|
| EP | 1 063 625 A1 | 12/2000 |

(Continued)

OTHER PUBLICATIONS

International Search Report dated Jan. 3, 2005 including an English translation of the pertinent portions (Five (5) pages).

(Continued)

*Primary Examiner*—Eric M Blount
(74) *Attorney, Agent, or Firm*—Crowell & Moring LLP

(57) ABSTRACT

A method is provided for the use-dependent information presentation in a motor vehicle. In order to provide use-dependent information presentation in a motor vehicle acceptable to the vehicle user, the following actions occur. Information intended for the presentation for a plurality of different types of use of the motor vehicle are transmitted and stored in the motor vehicle. The type of use of the vehicle is determined. And, the information from the plurality of information for the different types of use, which had been intended for the presentation for the determined type of use, is presented.

18 Claims, 1 Drawing Sheet

U.S. PATENT DOCUMENTS

| | | | | |
|---|---|---|---|---|
| 2003/0001887 | A1* | 1/2003 | Smith, IV | 345/741 |
| 2004/0093155 | A1* | 5/2004 | Simonds et al. | 701/200 |
| 2005/0091175 | A9* | 4/2005 | Farmer | 705/400 |

FOREIGN PATENT DOCUMENTS

| | | | |
|---|---|---|---|
| EP | 1 076 431 | A2 | 2/2001 |
| EP | 1 098 286 | A2 | 5/2001 |
| EP | 1 100 063 | B1 | 5/2001 |
| EP | 0 921 510 | B1 | 8/2003 |
| EP | 1 353 260 | B1 | 5/2006 |
| WO | WO 01/79876 | A2 | 10/2001 |

OTHER PUBLICATIONS

Forms PCT/IB/338, PCT/IB/373, and PCT/ISA/237 (English translation)—(Twelve (12) pages), Nov. 9, 2006.

* cited by examiner

UTILIZATION-DEPENDENT DATA REPRESENTATION IN A MOTOR VEHICLE

CROSS-REFERENCE TO RELATED APPLICATIONS

This application is a continuation of PCT International Application No. PCT/EP2004/004667, filed Apr. 29, 2004, the entire disclosure of which is expressly incorporated by reference herein.

BACKGROUND AND SUMMARY OF THE INVENTION

The invention relates, in particular, to a method for the utilization-dependent information representation in a motor vehicle.

There is an interest in offering products and/or services in a targeted manner to a vehicle purchaser even after the purchase of a vehicle as a function of his driving style, the mileage of the vehicle, etc.

It is a disadvantage that, for this purpose, also the corresponding information concerning the driver's driving style, the mileage of the vehicle, etc. would have to be transmitted. This results in reservations with respect to the protection of data privacy and with respect to user acceptance.

It is an object of the present invention to provide a utilization-dependent information presentation in a motor vehicle, which is considered to be advantageous and acceptable to a vehicle user.

With respect to the method, this object is achieved by providing a method for the utilization-dependent information presentation in a motor vehicle. The method performs the acts of: transmitting and storing, within the motor vehicle, information intended for the presentation for a plurality of different types of use of the motor vehicle, determining the type of use of the vehicle, and presenting that information from the plurality of information for the different types of use which had been intended for the presentation for the determined type of use. Advantageous further developments of the invention are described and claimed herein.

Other objects, advantages and novel features of the present invention will become apparent from the following detailed description of the invention when considered in conjunction with the accompanying drawings.

DETAILED DESCRIPTION OF THE DRAWING

Figure 1:
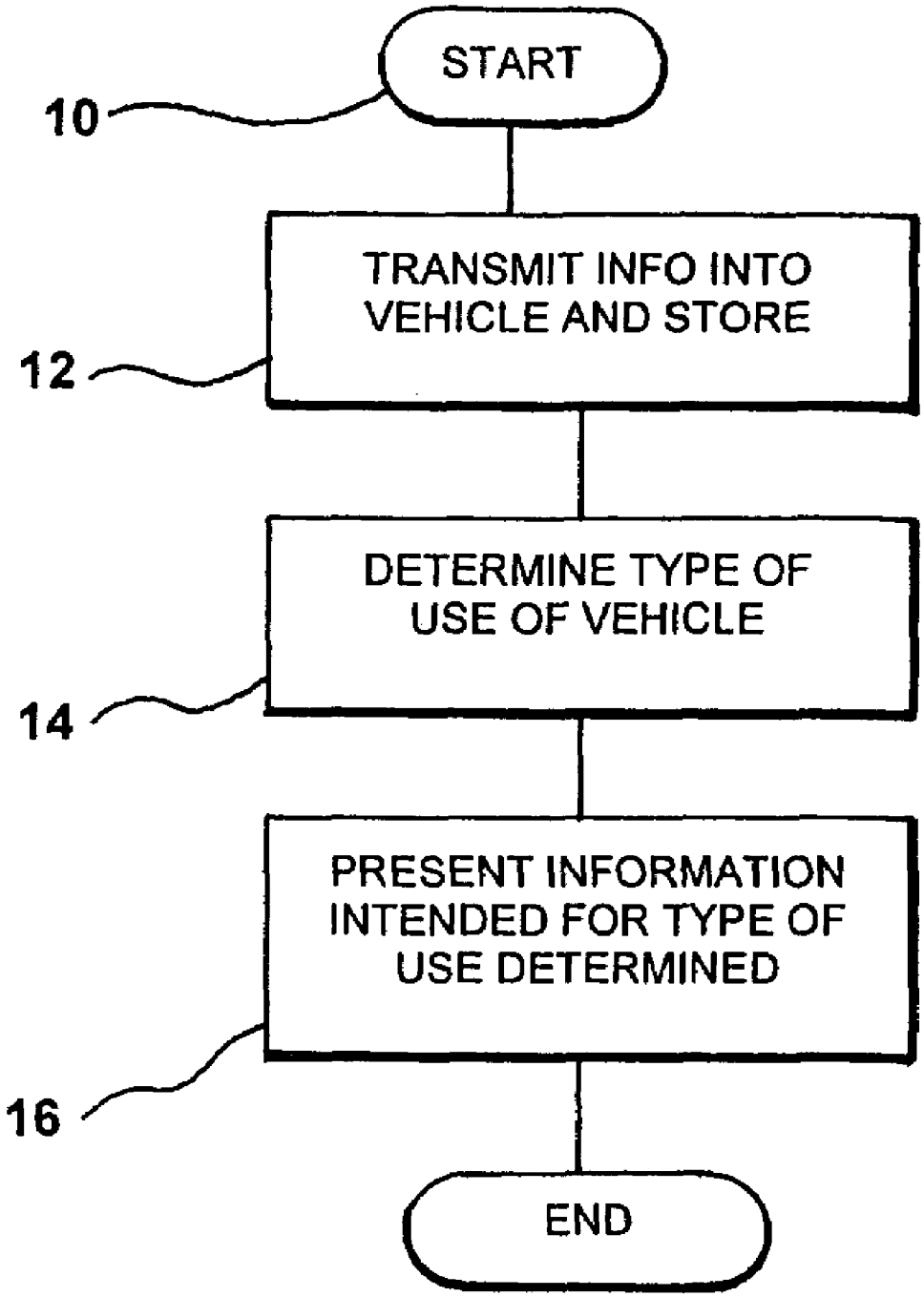
FIG. 1 is a flow chart illustrating the method according to the present invention.

One aspect of the method of the invention for the use-dependent information representation in a motor vehicle includes the implementation of the following acts as shown in FIG. 1.

In a first act 12, the information provided for the representation on a display in the vehicle to the driver or the front passenger for a plurality of different types of use of the motor vehicle is transmitted into the motor vehicle from outside the vehicle and is stored in the vehicle.

In a second act 14, the type of use of the vehicle is determined, and, in a third act 16, the presentation of that information from the plurality of information takes place, which had been intended for representation for the determined type of use.

As a result, the type of use is determined in the vehicle, and that information is selected from the plurality of information in the vehicle for representation, which is intended for the display for the concrete type of use. According to the invention, the concrete type of use (or the characteristics or data characterizing the concrete type of use) remain in the vehicle. An export of information or data, which may be questionable with respect to the protection of data privacy into an IT environment outside the vehicle is not required for the information targeted to the driver or the front passenger.

In an embodiment of the invention, the method checks whether the vehicle is moving and/or whether the driver would be too distracted by the presentation of information. In particular, it can be provided that the information presentation may be switched off manually, and/or takes place only when the vehicle is parked, and/or is no longer carried out visually but only acoustically.

In an embodiment of the invention, it is provided that, in addition to the information intended for the presentation, a first sequence control is transmitted and stored in the vehicle, which permits a manual selection of a desired presentation from the total quantity of information. The selection preferably takes place in the manner of menus and/or directories.

The first sequence control or software is implemented by a computer in the vehicle, particularly by a control device equipped with a microprocessor. Independently of the determined (current) type of use, the user can manually surf through the entire offered information. A browser-like sequence control is preferably provided to the user, by which the user selects topics which interest him from the total information by use of menus or directories.

In an embodiment of the invention, it is provided that the information offers a product or a service to be purchased or used, and a second sequence control is transmitted into the vehicle and is stored in the vehicle, by which the product or the service can be acquired, preferably in the form of an electronic payment transaction.

In a further development of the invention, it is additionally provided that the product or the service is a third sequence control, which may be downloaded into the vehicle, and/or a data quantity and/or a clearing code, which clears a sequence control or a data quantity for a use, particularly for the operation of a navigation system.

In a further development of the invention, it is additionally provided that the product or the service is made available in a limited manner with respect to time, location, or with respect to a route of the vehicle; for example, for the next 1,000 kilometers or the next two weeks.

Thus, for example, providing a routing for the corresponding current location could be offered to the driver, which is determined, for example, by way of a navigation system with a GPS receiver installed in the vehicle. This could be offered to the driver, for example, when the navigation system or another suitable device in the vehicle recognizes that the driver is lost. One indication in this respect could be detecting multiple brakings at crossroads and a subsequent continuation beyond the crossroads; that is, an indication that a lost driver is obviously searching for a specific street.

In an embodiment of the invention, it is provided that the selection and presentation of the information and/or products and/or services is carried out as a function of the type of use; for example, as a function of the driving style, of the weather situation, of the driving situation, and/or the traffic situation, the mileage, the driver's reaction speed, the average speed, the type of road, for example, city traffic, country road or expressway, a search for a parking space, a search of a different type or a parking operation. In the case of the latter types of use of the vehicle, assistance could be offered, for example, by clearing an electronic parking assistant already situated in the vehicle.

When the driver's reaction starts to slow down, he could be offered, for example, a routing to the nearest rest stop or parking area by using a navigation system provided in the vehicle and/or cleared specifically for this purpose. When it is detected that the vehicle would shortly drive into a traffic jam, an alternate route could be offered to the driver by using the navigation system. When it is detected that the vehicle is moving in fog, the driver could be offered a driver assistance system for improving the visibility in fog, for example, by use of a display of an image obtained by using infrared sensors arranged on the vehicle. Likewise, the driver could be offered the use of a driver assistance system in the form of a night vision system with infrared sensors, a parking aid, the use of a reversing camera, a routing to a vacant parking space situated nearby, for example, a parking garage, etc.

In an embodiment of the invention, the information intended for the presentation and/or the first sequence control and/or the second sequence control and/or the third sequence control and/or the clearing code are provided with a signature before being transmitted into a vehicle.

In a further development of the invention, it is provided that a secret key be used for the signature. This preferably is the secret key of a pair of public keys.

The hash value of the information to be signed or of the data to be signed or of the sequence control to be signed or of the clearing code to be signed is preferably formed by means of a hash algorithm. This first hash value is encoded by use of the secret key of a pair of public keys, and the encoded hash value (the signature) is transmitted into the vehicle together with the signed data. In the vehicle, the public key of the pair of public keys is situated, which is preferably stored in a readable unchangeable form in the vehicle or in a control device of the vehicle in a controlled secure environment during the manufacture of the vehicle. Before the signed data are used, they are checked in the vehicle by way of the signature with respect to data corruption. For this purpose, the same hash algorithm is applied to the data, etc. The result is a second hash value. The signature is decoded by use of the public key and the first hash value is obtained. A comparison takes place in the vehicle (or by a device of the vehicle) as to whether the first hash value corresponds to the second hash value. If this is so, the data, etc. are considered to be authentic or uncorrupted and are used in the vehicle in the intended manner. Otherwise, the data, etc. are not used or not implemented.

Furthermore, the invention permits an advantageous man-machine interface which implements a method according to the invention for the use-dependent information presentation in a motor vehicle. In addition, the invention provides an advantageous computer program product for the use-dependent information presentation in a motor vehicle, which allows the running of a process according to the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for utilization-dependent information presentation in a motor vehicle, the method comprising the acts of:

transmitting into the motor vehicle information intended for the presentation for a plurality of different types of use of the motor vehicle and storing the information therein;

determining in the vehicle the type of use of the vehicle, wherein determining the type of use includes determining driver actions for operation of the motor vehicle and a current driving condition of the motor vehicle; and presenting select information for the determined type of use from the information for the different types of use intended for the presentation, based, at least in part, on the driver actions for operation of the motor vehicle and the current driving condition.

2. The method according to claim 1, further comprising the act of transmitting into the vehicle, and storing therein, a first sequence control permitting a manual selection of a desired presentation from all of the information intended for the presentation, wherein the manual selection occurs by use of at least one of a menu and a directory.

3. The method according to claim 2, wherein the information offers a product or a service for purchase, the method further comprising the act of transmitting a second sequence control into the vehicle and storing it therein, by which said second sequence control the product or the service is purchasable.

4. The method according to claim 3, wherein the product or service is purchasable via an electronic-type of payment transaction.

5. The method according to claim 3, wherein the product or service is a third sequence control, which is downloadable into the vehicle.

6. The method according to claim 3, wherein the product or the service is at least one of a data quantity and a clearing code which clears a sequence control and/or a data quantity for use.

7. The method according to claim 5, wherein the third sequence control is for use with a navigation system.

8. The method according to claim 6, wherein the data quantity and/or clearing code are for use with a navigation system.

9. The method according to claim 7, wherein the product or the service is provided in a limited manner with respect to time, location, or with respect to a route of the vehicle.

10. The method according to claim 8, wherein the product or the service is provided in a limited manner with respect to time, location, or with respect to a route of the vehicle.

11. The method according to claim 1, wherein the presentation of the select information takes places as a function of the type of use.

12. The method according to claim 11, wherein the type of use is at least one of a driving style, a weather situation, a driving and/or traffic situation, a mileage, a driver's reaction speed, an average speed, a type of road, a parking space search, a general search, and a parking operation.

13. The method according to claim 5, wherein at least one of: the information intended for the presentation, the first sequence control, the second sequence control, the third sequence control, and the clearing code, are provided with a signature before being transmitted into the vehicle.

14. The method according to claim 13, wherein a secret key is used for the signature.

15. The method according to claim 14, wherein the secret key is a secret key for a pair of public keys.

16. A man-machine interface for the use-dependent information presentation in a motor vehicle, the man-machine interface carrying out the method according to claim 1.

17. A computer program product for the use-dependent information presentation in a motor vehicle, the computer program product comprising a program stored on a computer readable medium and implementing the method according to claim 1.

18. A method for utilization-dependent information presentation in a motor vehicle, the method comprising the acts of:

receiving, from an exterior source, in the motor vehicle information intended for presentation for a plurality of different types of use of the motor vehicle;

storing the information in the motor vehicle;

determining, in the vehicle, a type of use of the vehicle, wherein determining the type of use includes determining driver actions for operation of the motor vehicle and a current driving condition of the motor vehicle; and based on the driver actions for operation of the motor vehicle and the current driving condition, presenting to a user of the vehicle information from the received information.

* * * * *